US010323550B1

(12) United States Patent
Fluharty et al.

(10) Patent No.: US 10,323,550 B1
(45) Date of Patent: Jun. 18, 2019

(54) PROTECTION FOR HYDRAULIC LIFTERS

(71) Applicant: Ford Global Technologies, LLC, Dearborn, MI (US)

(72) Inventors: Jeffrey Fluharty, Woodhaven, MI (US); Robert Furby, Novi, MI (US); Chris Rowley, Wanstead (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/921,253

(22) Filed: Mar. 14, 2018

(51) Int. Cl.

| | |
|---|---|
| ***F01L 1/24*** | (2006.01) |
| ***F01L 1/053*** | (2006.01) |
| ***F01L 1/18*** | (2006.01) |
| ***F01L 13/00*** | (2006.01) |
| *F01M 1/10* | (2006.01) |
| *F01M 1/02* | (2006.01) |

(52) U.S. Cl.
CPC ..... *F01L 1/2416* (2013.01); *F01L 1/053* (2013.01); *F01L 1/181* (2013.01); *F01L 13/0005* (2013.01); *F01L 2001/2444* (2013.01); *F01M 1/02* (2013.01); *F01M 1/10* (2013.01); *F01M 2001/1028* (2013.01)

(58) Field of Classification Search
CPC ..... F01L 1/2405; F01L 1/2416; F01L 2001/2444; F01L 1/46; F01L 13/0005
USPC ..... 123/90.12, 90.16, 90.43, 90.46
See application file for complete search history.

(56) References Cited

U.S. PATENT DOCUMENTS

| | | | | |
|---|---|---|---|---|
| 3,025,842 | A | 3/1962 | Van Slooten | |
| 6,237,559 | B1 | 5/2001 | Russ | |
| 6,439,186 | B1 | 8/2002 | Owen | |
| 2006/0225684 | A1 | 10/2006 | Spath | |
| 2009/0050102 | A1 | 2/2009 | Strandburg | |
| 2010/0192889 | A1* | 8/2010 | Radulescu | F01L 1/185 123/90.45 |
| 2011/0061615 | A1* | 3/2011 | Hendriksma | F01L 1/24 123/90.15 |
| 2014/0251243 | A1* | 9/2014 | Nakamura | F01L 13/0015 123/90.15 |
| 2015/0167507 | A1* | 6/2015 | Aimo Boot | F01L 1/2405 74/569 |
| 2016/0102585 | A1* | 4/2016 | Evans | F01L 1/146 123/90.12 |

(Continued)

FOREIGN PATENT DOCUMENTS

WO 2001011200 A1 2/2001

*Primary Examiner* — Jorge L Leon, Jr.
(74) *Attorney, Agent, or Firm* — Gregory P. Brown; Diana D. Brehob; Brehob Law, PLLC

(57) ABSTRACT

In variable displacement engines, a portion of the intake valves have deactivatable valve lifters. When the engine conditions are such that some of the cylinders are to be deactivated, the intake and/or exhaust valve lifters in those cylinders are deactivated. Operation of the mechanism inside the lifter that is actuated to deactivate the valves can be harmed when particles in the engine oil get inside. To prevent small particles entering the valve lifter, a small filter is provided just upstream of the orifice into which oil enters the valve lifter. In other embodiments, a wire mesh formed into a coil is inserted into the recess. In some applications, a cage with snap-fitting connectors is installed over the filter to keep the wire mesh in place and properly coiled. The cage also fits into the recess. Such filter may also be applied to a hydraulic lash adjuster feature in a lifter.

19 Claims, 5 Drawing Sheets

(56) References Cited

U.S. PATENT DOCUMENTS

| | | | | |
|---|---|---|---|---|
| 2017/0002703 | A1* | 1/2017 | Khadilkar | F01M 1/10 |
| 2017/0321575 | A1* | 11/2017 | Wetzel | F01L 1/047 |
| 2018/0058344 | A1* | 3/2018 | Nishimoto | F01L 13/0005 |
| 2018/0283241 | A1* | 10/2018 | Cecil | F01L 1/255 |
| 2018/0355768 | A1* | 12/2018 | Biermann | F01L 1/46 |

* cited by examiner

PROTECTION FOR HYDRAULIC LIFTERS

FIELD

The present disclosure relates to preventing engine oil debris from entering a hydraulic lifter, particularly a deactivatable lifter.

BACKGROUND

Internal combustion engines typically use hydraulic valve lash adjusting lifters to maintain a zero valve clearance. Older style solid lifters maintain a small clearance between the valve and its rocker or cam follower. These solid lifters wear and must be adjusted periodically so that the clearance is not so great as to lead to undesirable levels of tappet noise, a clacking sound. With the hydraulic lifter, pressurized engine oil is supplied to hydraulic valve lash adjusting lifter through a small hole in the lifter body. When the engine valve is closed (lifter in a neutral position), the lifter is free to fill with oil thereby increasing the length of the lifter. As the camshaft lobe enters the lift phase of its travel, it compresses the lifter piston, and a valve shuts the oil inlet. Oil is nearly incompressible, so this greater pressure renders the lifter effectively solid during the lift phase. As the camshaft lobe returns to its base circle after passing through its apex the load is reduced on the lifter piston, and the internal spring returns the piston to its neutral state so the lifter can refill with oil. This small range of travel in the lifter's piston is enough to allow the elimination of the constant lash adjustment. It is desirable to keep debris out of the internal mechanism to ensure proper operation.

Even more sensitive than the lash adjusting function of the lifter is a valve deactivation system. Some internal combustion engines have valve deactivators on intake and/or exhaust valves on a pre-selected portion of engine cylinders. In a latched position, the valve deactivator is locked for normal operation of the valves. In an unlatched position, the lifter body is allowed to collapse and thereby fails to actuate the intake valves in engine cylinders in which an unlatch signal has been sent. The reason for deactivating a portion of cylinders is to achieve higher fuel efficiency by operating a fewer number of cylinders at a higher torque operating condition as opposed to operating all engine cylinders at a low torque operating condition, the latter of which is inherently less efficient in a spark-ignition engine. Movement of the latch assembly within the lifter is achieved by providing (or not providing) engine oil pressure in a fluid circuit dedicated for such control.

In some applications, pressurized oil for causing valve deactivation is provided to a lifter and the lost-motion or collapsible hardware is contained within the rocker arm such that the rocker arm collapses and fails to actuate the intake or exhaust valve with which it is associated. In either the case of the collapsing hardware being located in the rocker arm or in the lifter, the pressurized oil is provided to the lifter to access the collapsing hardware.

It is well known that regardless of measures taken to clean out machining and casting debris from an engine off the line, some debris remains. It has been found, particularly in the valve deactivator portion of the valve lifter (or rocker arm) such debris can cause malfunctions. Current strategies to prevent debris from entering the deactivator oil circuit within the valve lifter has been found to help; yet fails to be a guarantee for preventing debris ingress. Some way to protect the valve deactivator or rocker arm portion of the lifter and/or the valve lash adjuster portion of the lifter from being provided debris-contaminated engine oil is desired.

SUMMARY

To overcome at least one problem in the prior art a hydraulic valve lifter is disclosed that includes a lifter body, a valve deactivator recess defined in the lifter body, a valve deactivator orifice defined in the recess, such orifice providing a passage for oil into a valve deactivator portion of the valve lifter, and a filter provided within the valve deactivator recess. The filter is located to filter oil flowing into the valve deactivator orifice.

The filter is substantially flat with a center section slightly deformed to form a peak; and the peak is inserted into the valve deactivator orifice.

The filter is welded to the recess proximate the orifice defined in the recess. In an alternative embodiment, an adhesive is used to couple the filter to the recess.

The filter is wire mesh of a predetermined opening size.

The lifter further includes: a lash adjuster recess defined in the lifter body, a lash adjuster orifice defined in the lash adjuster recess in the lifter body, a lash adjuster orifice defined in the lash adjuster orifice recess; and a lash adjuster filter installed in the lash adjuster recess and located on the upstream side of the lash adjuster. The adjuster orifice provides a passage for oil into a lash adjuster portion of the valve lifter. In some embodiments, the lash adjuster filter is substantially circular, yet can be any suitable shape. The lash adjuster filter has a diameter greater than the lash adjuster orifice; and the filter is coupled to the lash adjuster recess proximate the lash adjuster orifice by an adhesive, a weld, or any suitable coupling feature.

In some embodiments, the filter is a wire mesh strip that has been formed into a coil. The coil is uncoiled sufficiently to install over the lifter and the coil is allowed to recoil into the recess.

Some embodiments include a cage disposed in the recess over the filter. The cage includes multiple sections that are coupled together via one or more snap-fit connectors.

Also disclosed is a variable displacement engine that has at least one engine cylinder having at least one intake or exhaust poppet valve and a rocker arm touching the valve on a first end of the rocker arm and a deactivatable lifter on a second end of the rocker arm. A body of the deactivatable lifter has a recess defined therein with a valve deactivator orifice defined in the recess, such orifice providing a passage for oil into a valve deactivator portion of the lifter. A filter, located upstream of the valve deactivator orifice, is provided within the valve deactivator recess.

In some embodiments, the filter is substantially flat with a center section slightly deformed to form a peak. The peak is inserted into the valve deactivator orifice.

The filter is coupled to the recess proximate the orifice defined in the recess.

The engine has an oil circuit providing lubricating oil to the engine, an oil pump disposed in the oil circuit, a branch of the oil circuit fluidly coupled to the valve deactivator orifice, and a control valve disposed in the branch. Also included is an electronic control unit (ECU) electronically coupled to the control valve. The control valve has a latched position and an unlatched position. The ECU commands the control valve position based at least on demanded engine torque.

In some embodiments, a lash adjuster recess defined in the body of the lifter. a lash adjuster orifice defined in the lash adjuster recess, a lash adjuster filter disposed in the lash adjuster recess, an oil circuit providing lubricating oil to the engine, an oil pump disposed in the oil circuit, and a branch of the oil circuit fluidly coupled to the lash adjuster orifice.

The engine further includes a deactivatable lifter associated with a valve of the engine (intake or exhaust valve), a body of the deactivatable lifter has a recess defined therein with a valve deactivator orifice defined in the recess, such orifice providing a passage for oil into a valve deactivator portion of the lifter, and a filter provided within the valve deactivator recess.

The filter is placed over the valve deactivator orifice and edges of the filter are welded to the recess proximate the orifice or coupled in any suitable manner.

The engine also includes a cylinder head with at least one intake valve, a bore defined in the cylinder head to accept the lifter, an oil circuit with an oil pump pressurizing the oil and oil provide to the cylinder head and a branch provided to the deactivatable lifter, a solenoid valve provided in the branch, and an electronic control unit (ECU) electronically coupled to the solenoid.

The ECU receives a plurality of signals from engine sensors; based on the signals, the ECU commands solenoid valve position.

The filter is a wire mesh of a predetermined opening size.

The engine, in some embodiments, also includes: a lash adjuster recess defined in the body of the lifter, a lash adjuster orifice defined in the lash adjuster recess, and a lash adjuster filter disposed in the lash adjuster recess.

The engine has an oil circuit providing lubricating oil to the engine, an oil pump disposed in the oil circuit, and a branch of the oil circuit fluidly coupled to the lash adjuster orifice.

In some embodiments, the lash adjuster filter is a wire mesh strip that has been formed into a coil. The coil is uncoiled sufficiently to install over the lifter. The coil is allowed to recoil into the lash adjuster recess.

Some embodiments include a cage disposed in the recess over the lash adjuster filter. The has multiple sections that are coupled together via one or more snap-fit connectors.

In some embodiments, the lash adjuster filter is provided upstream of the lash adjuster orifice and coupled to the lash adjuster recess.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
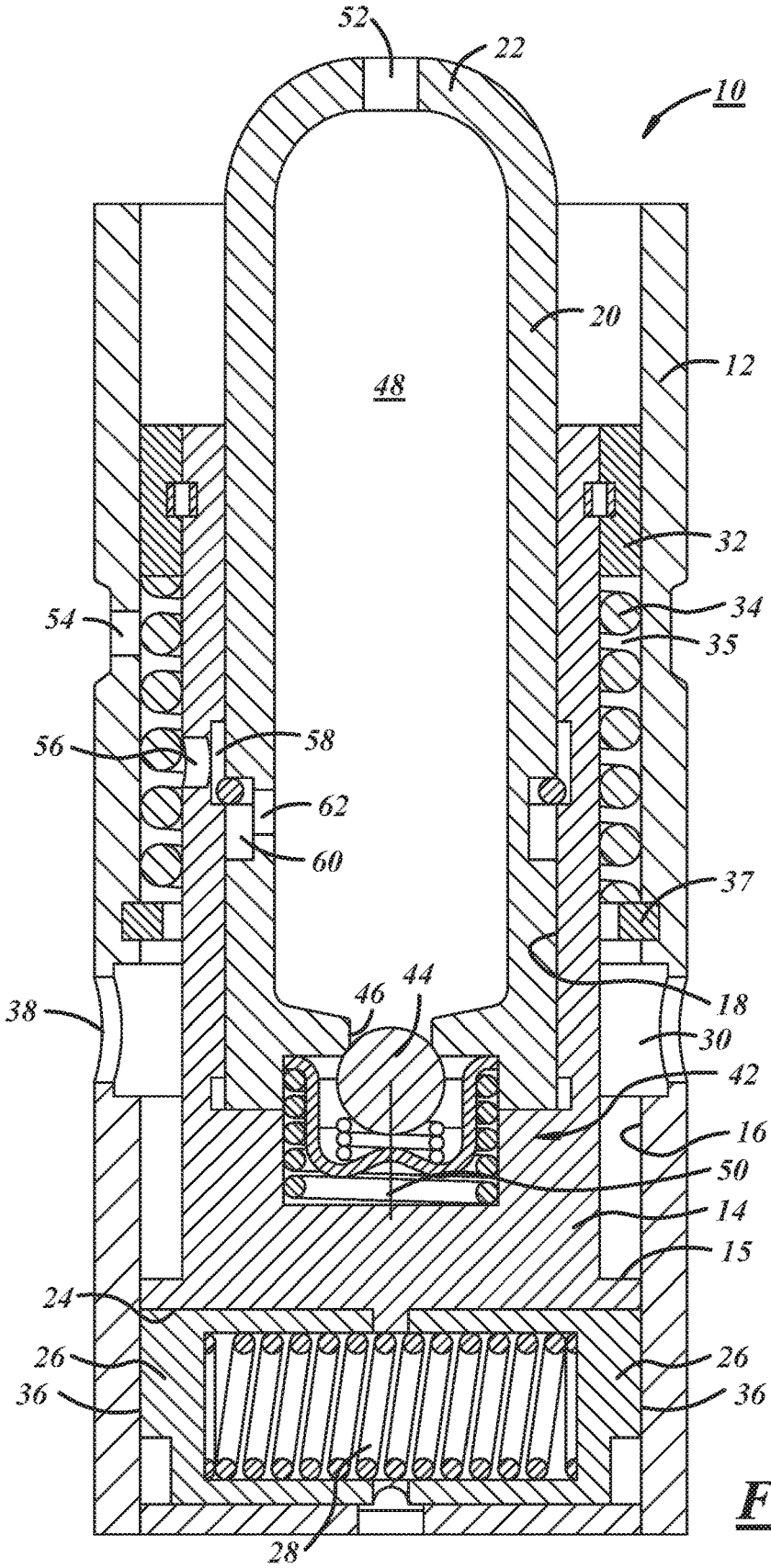
FIG. 1 is an illustration of a deactivatable hydraulic lash adjusting lifter.

A deactivating hydraulic lash adjusting valve lifter 10 is shown in FIG. 1. Lifter 10 has a generally cylindrical body 12. A pin housing 14 is disposed within an axial bore 16 defined in adjuster body 12. Pin housing 14 also has an axial bore 18 for receiving a plunger 20 that has a domed end 22 for engaging with a roller finger follower in an overhead-cam engine valve train.

Pin housing 14 has a transverse bore 24 with two opposed locking pins separated by a pin-locking spring 28. Axial bore 16 is provided with a circumferential groove 30 for receiving the outer ends of locking pins 26. Locking pins 26 are thrust outwards by spring 28 when pins 26 are aligned with groove 30. When in such position, valve lifter is in valve-activation mode. As shown in FIG. 1, however, valve lifter is in valve-deactivation mode.

Upper end 32 of pin housing 14 defines a first seat for a lost-motion return spring 34 disposed within a spring chamber 35, i.e., the space between bore 16 and pin housing 14. Annular stop 37 serves as a second seat for lost-motion spring 34.

Groove 30 defines a reservoir for providing high pressure oil against the outer ends 36 of locking pins 26 to overcome spring 28 and retract the locking pins into bore 24 to unlock the pin housing from the lifter body to deactivate the lifter. Groove 30 is in fluidic communication with an engine oil gallery (not shown) via a port 38. Groove 30 is supplied pressurized engine oil when it is determined that deactivation of the valve is desired. Plunger 20 includes check valve components lodged at an inner end. Check valve components include a spring-loaded check ball 44 lodged against a seat 46 formed in plunger 20 separating a low-pressure oil reservoir 48 from a high-pressure chamber 50. Oil is supplied to annular chamber 35 from an engine oil gallery via a port 54 in lifter body 12. Chamber 35 is also in fluidic communication with reservoir 48 via a port 56 and annular groove 58 in pin housing 14 and annular groove 60 and port 62 in plunger 20.

Lifter 10 is disposed in a bore in the engine with adjuster body 12 remaining stationary. When an associated cam (not shown) exerts force on plunger end 22, in deactivation mode, plunger 20 and pin housing 14 are forced into body 12 in a lost-motion stroke, compression lost-motion spring 34. In normal operation, plunger 20 does not move relative to pin housing 14 and the intake valve associated with the cam is operated normally. As described above, the collapsible portion that leads to valve deactivation can alternatively be disposed within the rocker arm. In such embodiment, it is common for the oil provided to the rocker arm enters in the lifter and then travels to the rocker arm. Thus, according to embodiments of the present disclosure, having a filter upstream of the inlet orifice in the lifter protects the deactivatable hardware within the rocker arm.

Figure 2:
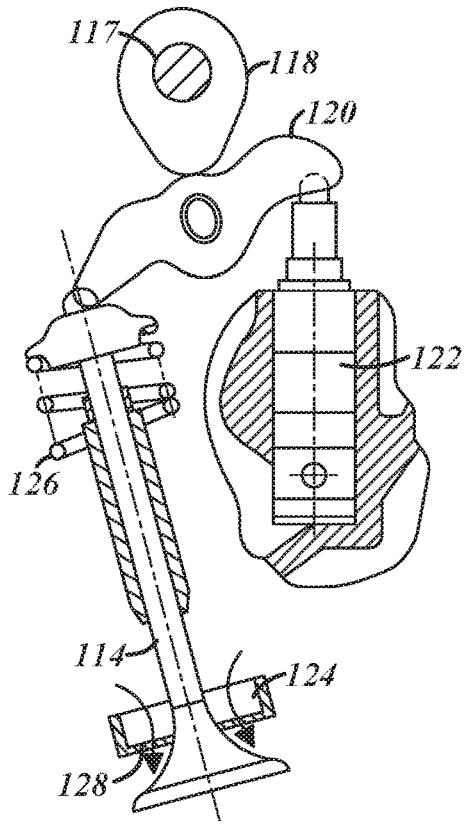
FIGS. 2 and 3 are illustrations of a portion of a valve train of an internal combustion engine with a deactivatable lifter.

In FIG. 2, an illustration of a deactivatable lifter 122 is shown in which lifter 122 is in an active state. A cam shaft 117 has multiple cam lobes, one cam lobe 118 is illustrated in a position in which it is pushing down on rocker arm 120. With lifter 122 activated, rocker arm 120 pushes down on an intake valve 114 thereby causing an associated valve spring 126 to compress. Valve 114 moves downward and lifts off its valve seat 128 to allow flow through intake port 124.

Figure 3:
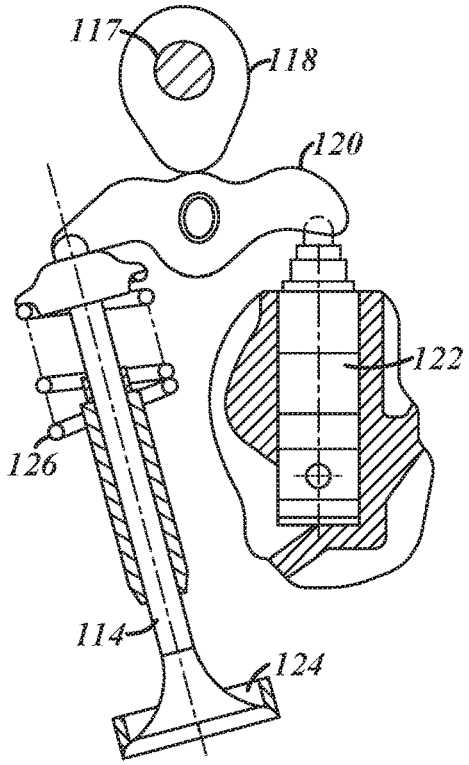

In FIG. 3, lifter 122 is in its deactivated state. Even though cam lobe 1118 is shown such that in its state that would push down on rocker arm 120, lifter 122 is collapsed so that there is no opening force exerted on valve 114. Valve 114 stays seated on valve seat (not visible in FIG. 3) and there is no flow through intake port 124.

Figure 4:
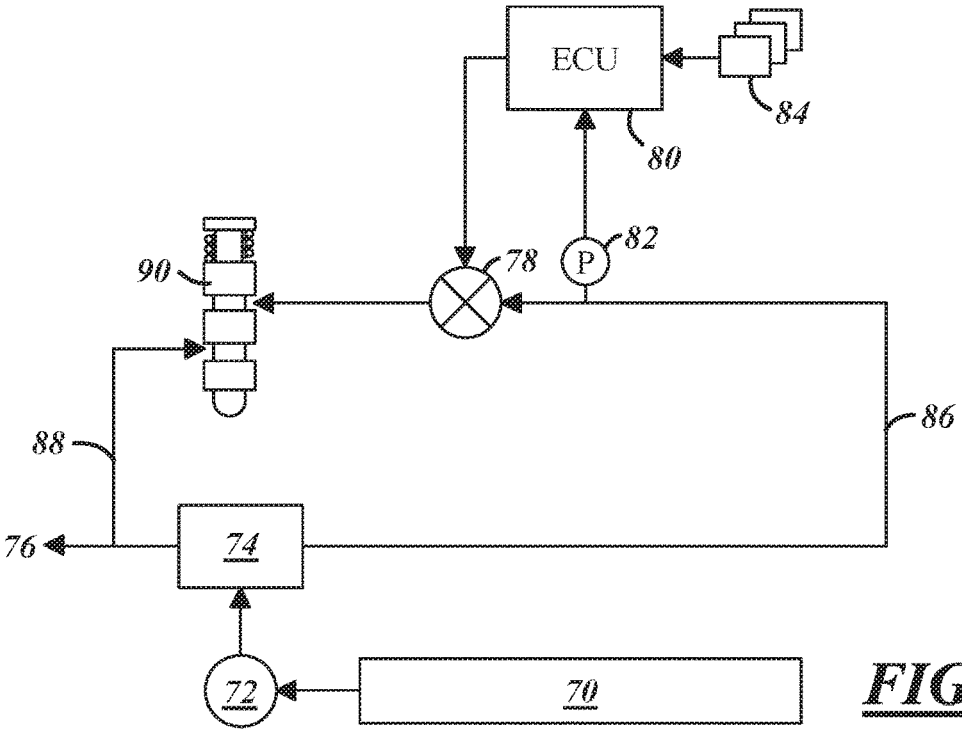
FIG. 4 shows a portion of an oil circuit for an internal combustion engine.

FIG. 4 shows the oil control branches relevant to a deactivatable hydraulic lash adjustable lifter 90. Engine oil in a sump 70 is picked up by an oil pump 72 and pressurized. Oil is provided to filter 74 before being sent to the engine along path 76, to a lash adjusting port (not separately shown in FIG. 4) of lifter 90 via branch 88, and to a valve deactivating port (not separately shown in FIG. 4) of lifter 90 via branch 86. Branch 86 includes a pressure sensor 82 that provides a signal to an electronic control unit (ECU) 80. ECU 80 is also provided many other sensor inputs 84 such as temperatures, engine speed, demanded engine torque, etc. Based on sensor inputs 84 and other inputs, ECU 80 determines when to demand deactivation of lifter 90. A control valve 78 disposed in branch 86, is commanded to open when deactivation of lifter 90 is demanded and commanded to close when deactivation is not desired.

Figure 5:
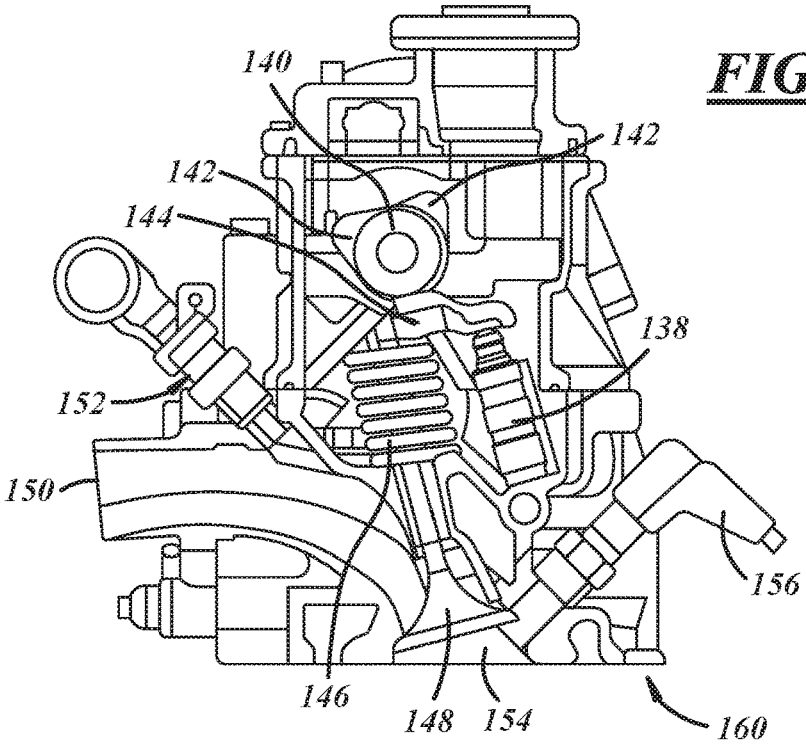
FIG. 5 is an illustration of a portion of an internal combustion engine.

A portion of a cylinder head 160 of an internal combustion engine is shown in cross section in FIG. 5. A camshaft 140 has multiple cam lobes 142 one of which acts on rocker arm 144. Lifter 138 is installed into a bore in cylinder head 160. If it is a lash adjusting lifter, it adjusts slightly to take up lash (clearance) in the valve, rocker arm, and cam system. In embodiments in which lifter 138 is a deactivatable lifter, upon command, lifter 138 collapses when cam lobe 142 pushes on rocker arm 144 so that the rocker arm 144 has no effect on an associated intake valve 148. Valve 148, remains closed via valve spring 146. If lifter is in an activated state and when lobe 142 acts upon rocker arm 144, valve 148 moves downward to open allowing flow through intake runner 150 into combustion chamber 154. A fuel injector sprays fuel into intake runner 150 that is swept into combustion chamber 154 with intake air during an intake stroke. A spark plug having a tip disposed in combustion chamber 154 ignites the fuel air mixture.

Figure 6:
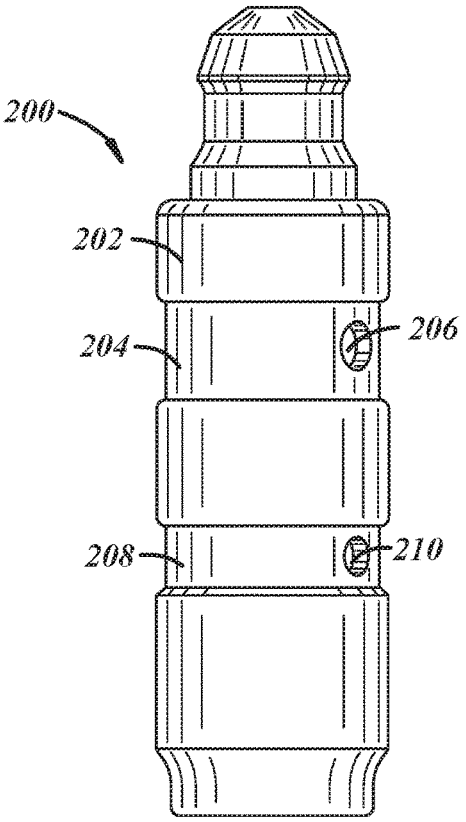
FIG. 6 shows a deactivatable hydraulic lash adjusting lifter.
Figure 7:
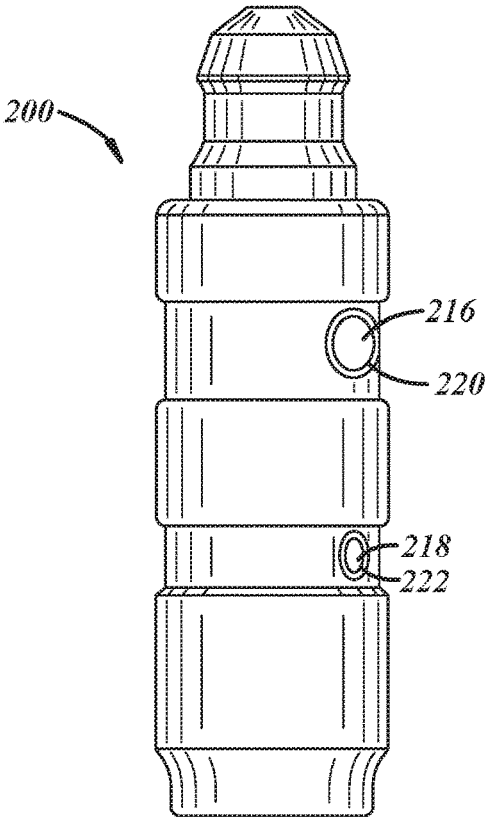
FIG. 7 shows a deactivatable hydraulic lash adjusting lifter with filters over orifices in the lifter.

A deactivatable hydraulic lash adjustable lifter 220 is shown in FIG. 6. A body 202 of lifter 200 has two recesses 204 and 208. Recess 204 has an orifice 206 that leads to a chamber within body 202 with the valve deactivation hardware. When pressurized oil is provided to orifice 206, lifter 220 is in deactivation mode and will collapse when a force exerted thereon. Recess 208 has an orifice 210 for maintaining lash adjustment. FIG. 7 shows filters 216 and 218 disposed over orifices 206 and 210, respectively. Filters 216 and 218 are wire mesh and have a predetermined mesh size to trap particles that might have passed through the oil filter (shown in FIG. 4). Filters 216 and 218 are welded to the surface of the recess to stay in place and to prevent particles from going around the filter. In some embodiments, the filter is coupled to the surface of the recess via adhesive. In the embodiment shown in FIG. 7, the filters are essentially circular and flat, yet any suitable shape can be used. Filters 216 and 218 are contained within recesses 204 and 208, respectively, so that lifter 200 can be inserted into the bore in the cylinder head (not shown in FIG. 7) for lifter 200. In FIG. 7, a weld bead 220 is shown around filter 216 and weld bead 222 around filter 218. In alternatives with adhesives, 220 and 222 are the adhesive material that might flow a bit outside of filters 216 and 218, respectively.

Figure 8:
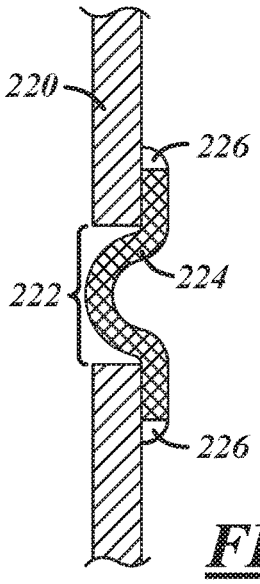
FIG. 8 shows a portion of a lifter body with a filter disposed near an orifice for oil ingress.

Referring now to FIG. 8, a portion of a lifter body has a recess 220 with an orifice 222 defined therein. A wire mesh filter 224 is not flat but is deformed to have a slight peak in its center. The peak is inserted into orifice 222. In some embodiments, this is helpful to locate filter 224 into orifice 222. Filter 224 is welded to recess 220 at its periphery as shown by weld beads 226. Alternatively, an adhesive or other suitable coupling protocol is employed. Filter 224 is shown as circular, yet can be any suitable shape.

Figure 9:
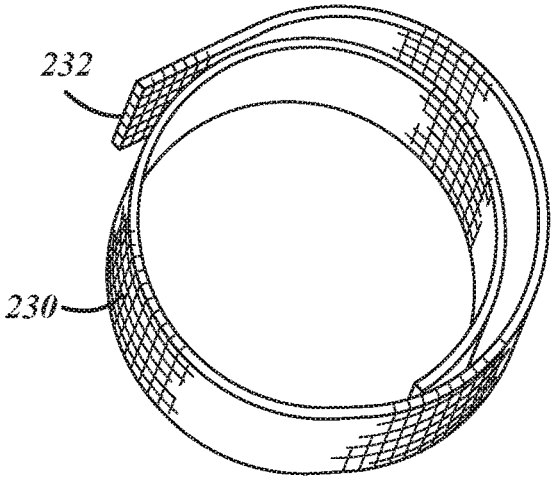
FIG. 9 shows a drawing of a coiled wire mesh filter strip.
Figure 10:
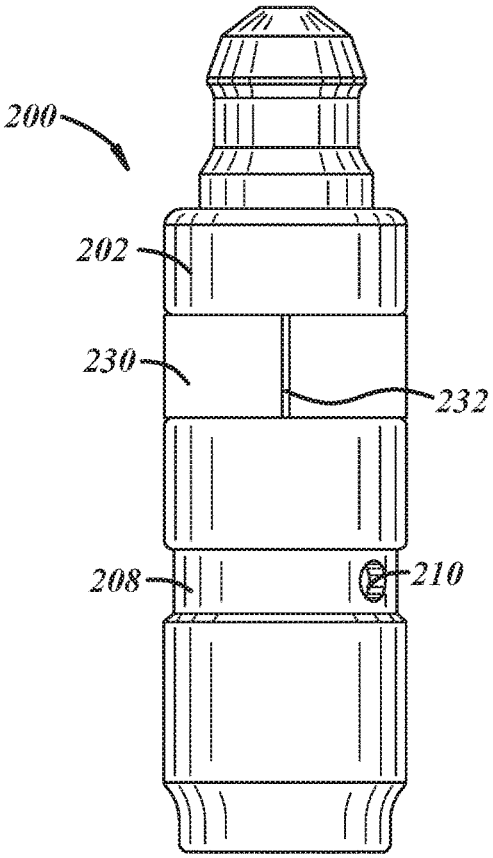
FIG. 10 shows a lifter with a coiled wire mesh filter disposed in a recess in the body of the lifter.

Referring to FIG. 9, a wire mesh strip is shown that has been coiled. In FIG. 10, a lifter 200 has coiled filter 230 disposed in an upper recess of lifter 200. End 232 of coiled filter 230 overlaps.

Figure 11:
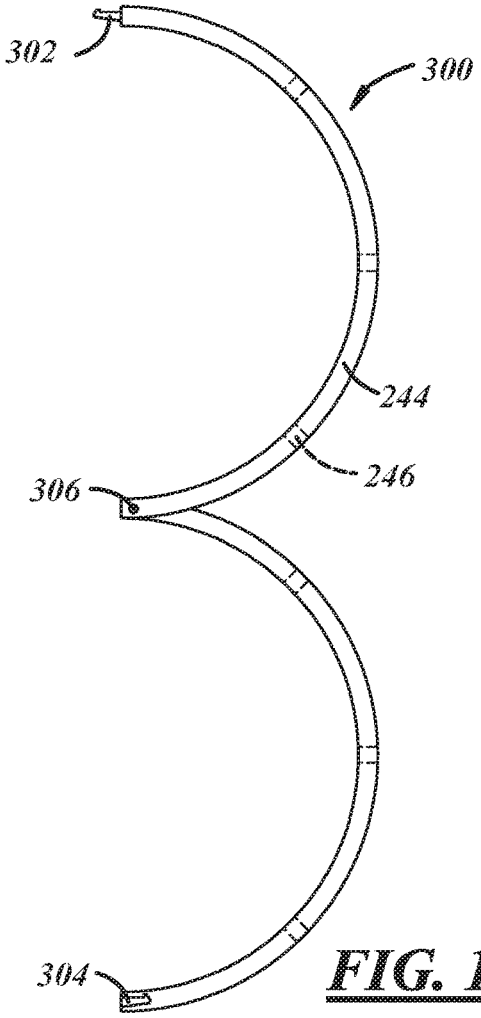
FIGS. 11 and 12 are two embodiments of a cage to hold a wire mesh filter strip in place in the recess.
Figure 13:
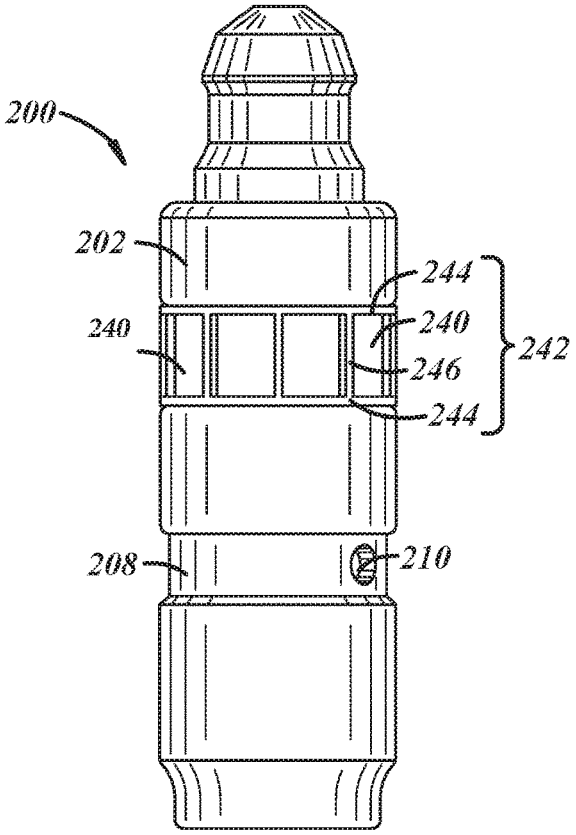
FIG. 13 shows a lifter with a coiled wire mesh filter and a cage over the filter.
Figure 12:
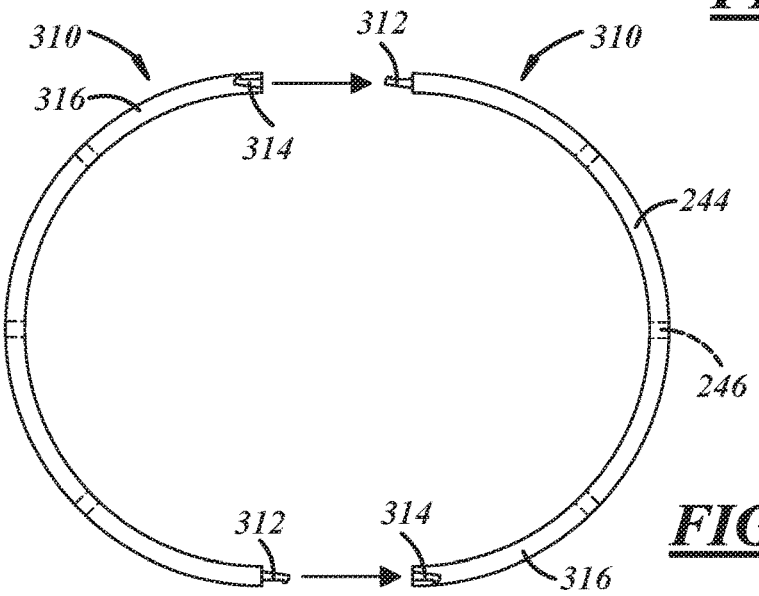

Cages 300 and 310 to hold a coiled filter in place are shown in FIGS. 11 and 12, respectively. Cage 300 (FIG. 11) has a hinged joint with a pivot pin 306 and also snap fits via a tab 302 that engages with an opening 304. Cage 310 (FIG. 12) is comprised of two interlocking sections 316, each of which have tab(s) 312 that engage with openings 314 to form a snap-fit connection. In FIG. 13, a cage 242 is shown in place over filter 240 in a recess of lifter 200. Either of cages 300 or 310 or any suitable retaining feature can be used to hold filter 240 in place in the recess. Cage 242 has windows through which oil flow passes through filter 240. Cage 242 has rings 244 at the top and bottom of the recess and vertical bars 246 spanning between rings 244.

Many of the illustrations have shown a filter provided in a recess associated with an oil inlet for valve deactivation in a lifter. Such filter is equally applicable to the hydraulic lash adjuster portion of a lifter. Furthermore, it is applicable to lifters with only a hydraulic lash adjuster orifice, i.e., do not have a recess and orifice for valve deactivation.

While the best mode contemplated by the inventors has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, recyclability, environmental factors, manufacturability, ease of assembly, etc. The embodiments described herein that are characterized as less desirable than other embodiments or prior art implementations with respect to one or more characteristics are not outside the scope of the disclosure and may be desirable for particular applications.

We claim:

1. A hydraulic valve lifter, comprising:

a lifter body;

a valve deactivator recess defined in the lifter body;

a valve deactivator orifice defined in the valve deactivator recess, the valve deactivator orifice providing a passage for oil into a valve deactivator portion of the valve lifter; and a filter provided within the valve deactivator recess, the filter located to filter oil flowing into the valve deactivator orifice.

2. The hydraulic valve lifter of claim 1 wherein the filter is substantially flat with a center section slightly deformed to form a peak; and the peak is inserted into the valve deactivator orifice.

3. The hydraulic valve lifter of claim 1 wherein the filter is coupled to the valve deactivator recess by one of welding or applying an adhesive.

4. The hydraulic valve lifter of claim 1 wherein the filter is a wire mesh strip that has been formed into a coil.

5. The hydraulic valve lifter of claim 1, further comprising:

a lash adjuster recess defined in the lifter body;

a lash adjuster orifice defined in the lash adjuster recess in the lifter body, the lash adjuster orifice providing a passage for oil into a lash adjuster portion of the valve lifter; and a lash adjuster filter installed in the lash adjuster recess and located on an upstream side of the lash adjuster orifice.

6. The hydraulic valve lifter of claim 5 wherein:

the filter is larger in area than the lash adjuster orifice; and the filter is welded to the lash adjuster recess proximate the lash adjuster orifice.

7. An internal combustion engine, comprising:

at least one engine cylinder having at least one intake valve; and a rocker arm touching the at least one intake valve on a first end of the rocker arm and a hydraulic lifter on a second end of the rocker arm wherein:

a body of the hydraulic lifter has a lash adjuster recess and a valve deactivator recess defined therein with a lash adjuster orifice defined in the lash adjuster recess and a valve deactivator orifice defined in the valve deactivator recess;

the lash adjuster orifice providing a passage for oil into a lash adjuster portion of the hydraulic lifter;

the valve deactivator orifice providing a passage for oil into a valve deactivator portion of the hydraulic lifter;

a lash adjuster filter provided within the lash adjuster recess, the lash adjuster filter located upstream of the lash adjuster orifice; and a valve deactivator filter provided within the valve deactivator recess, the valve deactivator filter located upstream of the valve deactivator orifice.

8. The engine of claim 7 wherein the lash adjuster filter is a wire mesh strip formed into a coil, the coil diameter being less than an outer diameter of the lash adjuster recess; and the wire mesh strip is uncoiled sufficiently to allow installation into the lash adjuster recess prior to allowing the wire mesh strip to recoil within the lash adjuster recess.

9. The engine of claim 7 wherein the lash adjuster filter is coupled to the lash adjuster recess proximate the lash adjuster orifice defined in the lash adjuster recess by one of welding and providing an adhesive.

10. The engine of claim 7, further comprising:

an oil circuit providing lubricating oil to the engine;

an oil pump disposed in the oil circuit;

a branch of the oil circuit fluidly coupled to the valve deactivator orifice;

a control valve disposed in the branch; and an electronic control unit (ECU) electronically coupled to the control valve wherein the control valve has a latched position and an unlatched position; and the ECU commands the control valve position based at least on demanded engine torque.

11. A variable displacement engine, comprising:

a deactivatable lifter associated with an intake valve of the engine;

a body of the deactivatable lifter has a valve deactivator recess defined therein with a valve deactivator orifice defined in the valve deactivator recess, the valve deactivator orifice providing a passage for oil into a valve deactivator portion of the deactivatable lifter; and a filter provided within the valve deactivator recess.

12. The variable displacement engine of claim 11 wherein the filter is placed over the valve deactivator orifice; the filter is coupled to the valve deactivator recess proximate the valve deactivator orifice by one of welding and by providing an adhesive between the filter and the valve deactivator recess.

13. The variable displacement engine of claim 12, further comprising:

a lash adjuster recess defined in the body of the deactivatable lifter;

a lash adjuster orifice defined in the lash adjuster recess; and a lash adjuster filter disposed in the lash adjuster recess.

14. The variable displacement engine of claim 13 wherein the lash adjuster filter is a wire mesh strip that has been formed into a coil; the coil is uncoiled sufficiently to install over the deactivatable lifter; and the coil is allowed to recoil into the lash adjuster recess.

15. The variable displacement engine of claim 14, further comprising: a cage disposed in the lash adjuster recess over the lash adjuster filter, the cage comprised of multiple sections that are coupled together via one or more snap-fit connectors.

16. The variable displacement engine of claim 14 wherein the lash adjuster filter is provided upstream of the lash adjuster orifice and coupled to the lash adjuster recess.

17. The variable displacement engine of claim 11 wherein the filter is deformed to have a small peak in a center of the filter; and the peak of the filter is inserted into the valve deactivator orifice prior to welding.

18. The variable displacement engine of claim 11 wherein the filter is a wire mesh strip that has been formed into a coil; the coil is uncoiled sufficiently to install over the deactivatable lifter; and the coil is allowed to recoil into the valve deactivator recess.

19. The variable displacement engine of claim 18, further comprising:

a cage disposed in the valve deactivator recess over the filter, the cage comprised of multiple sections that are coupled together via one or more snap-fit connectors.

* * * * *